US006773361B1

(12) United States Patent
Lee

(10) Patent No.: US 6,773,361 B1
(45) Date of Patent: Aug. 10, 2004

(54) METAL GOLF CLUB HEAD HAVING ADJUSTABLE WEIGHT

(76) Inventor: Chia Wen Lee, No. 82-12, San Long Road, Da Liao Hsiang, Kaoshiung Hsien (TW), 831

( * ) Notice: Subject to any disclaimer, the term of this patent is extended or adjusted under 35 U.S.C. 154(b) by 0 days.

(21) Appl. No.: 10/420,409

(22) Filed: Apr. 22, 2003

(51) Int. Cl.[7] ..... A63B 53/08
(52) U.S. Cl. ..... 473/335
(58) Field of Search ..... 473/334, 335, 473/336, 337, 338, 339, 290, 291, 226, 256, 350, 341, 342

(56) References Cited

U.S. PATENT DOCUMENTS 1,133,129 A * 3/1915 Govan ..... 473/337
3,955,820 A * 5/1976 Cochran et al. ..... 473/337
3,995,865 A * 12/1976 Cochran et al. ..... 473/337
4,213,613 A * 7/1980 Nygren ..... 473/327
4,607,846 A * 8/1986 Perkins ..... 473/336
4,754,977 A * 7/1988 Sahm ..... 473/337
4,919,431 A * 4/1990 Antonious ..... 473/350
5,013,041 A * 5/1991 Sun et al. ..... 473/252
5,082,278 A * 1/1992 Hsien ..... 473/242
5,447,307 A * 9/1995 Antonious ..... 473/350
5,616,088 A * 4/1997 Aizawa et al. ..... 473/341
6,015,354 A * 1/2000 Ahn et al. ..... 473/256
6,290,609 B1 * 9/2001 Takeda ..... 473/335

* cited by examiner

*Primary Examiner*—Gregory Vidovich
*Assistant Examiner*—Nini F. Legesse
(74) *Attorney, Agent, or Firm*—Charles E. Baxley

(57) ABSTRACT

A golf club head includes a metal head member, a weight element of smaller specific gravity attached to the upper portion and another weight element of greater specific gravity attached to the lower portion of the head member, to lower the center of gravity of the head member. One or more weight members may be selectively attached to the head member by the users themselves, in order to further adjust the head member to different center of gravity. The head member includes a screw hole formed in either or both of the rear and the front portions to tread with the weight member, and to adjust the center of gravity of the head member.

7 Claims, 3 Drawing Sheets

METAL GOLF CLUB HEAD HAVING ADJUSTABLE WEIGHT

BACKGROUND OF THE INVENTION

1. Field of the Invention

The present invention relates to a golf club head, and more particularly to a metal or iron golf club head having adjustable weight for different users.

2. Description of the Prior Art

Various kinds of typical golf club heads have been developed and comprise various designs for allowing the users to suitably strike the golf balls.

When different users strike the golf balls with the same metal or iron golf club heads, the golf balls may be stricken leftward by some of the users, and may be stricken rightward by the other users, and may be stricken straight ahead by the further users, due to different customs or postures or gestures.

For allowing the golf balls to be suitably stricken by the users toward the predetermined or required position, some of the typical metal or iron golf clubs may have various kinds of weights attached thereto, to adjust the typical metal or iron golf clubs to different weights, and thus to allow the users to strike the golf balls toward the predetermined or required position.

However, after the weights have been attached or secured onto the typical metal or iron golf clubs, the weights may no longer be adjusted relative to the typical metal or iron golf clubs, such that the users may not adjust the weights relative to the typical metal or iron golf clubs by themselves, and such that the users may not purchase and select the best metal or iron golf clubs that mostly fit their requirements.

The present invention has arisen to mitigate and/or obviate the afore-described disadvantages of the conventional metal or iron golf club heads.

SUMMARY OF THE INVENTION

The primary objective of the present invention is to provide a golf club head adjustable to different weight by the users themselves, and thus adjustable to different center of gravity to strike the golf balls toward the predetermined or required directions.

In accordance with one aspect of the invention, there is provided a golf club head comprising a metal head member including an upper portion, a lower portion, a front portion and a rear portion, at least one first weight element attached to the upper portion of the head member, and having a specific gravity smaller than that of the head member, at least one second weight element attached to the lower portion of the head member, and having a specific gravity greater than that of the head member, to lower a center of gravity of the head member, and at least one weight member attached to the head member, in order to adjust the head member to different center of gravity. The weight member may be selectively attached to the head member by the users themselves, in order to adjust the head member to different center of gravity.

The head member includes a screw hole formed in either or both of the rear and the front portions thereof to thread the weight member, and to adjust the center of gravity of the head member. One or more further weight members may be selectively threaded to the screw hole of the head member, in order to further adjust the center of gravity of the head member to different positions.

The head member includes a recess formed in the upper portion thereof to receive the first weight element, and having a narrower front portion and a broader rear portion, the first weight element includes a narrower front portion and a broader rear portion to engage into the narrower front portion and the broader rear portion of the recess of the head member, in order to adjust the center of gravity of the head member rearwardly.

The head member includes a recess formed in the lower portion thereof to receive the second weight element, and having a narrower front portion and a broader rear portion, the second weight element includes a narrower front portion and a broader rear portion to engage into the narrower front portion and the broader rear portion of the recess of the head member, in order to adjust the center of gravity of the head member rearwardly.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
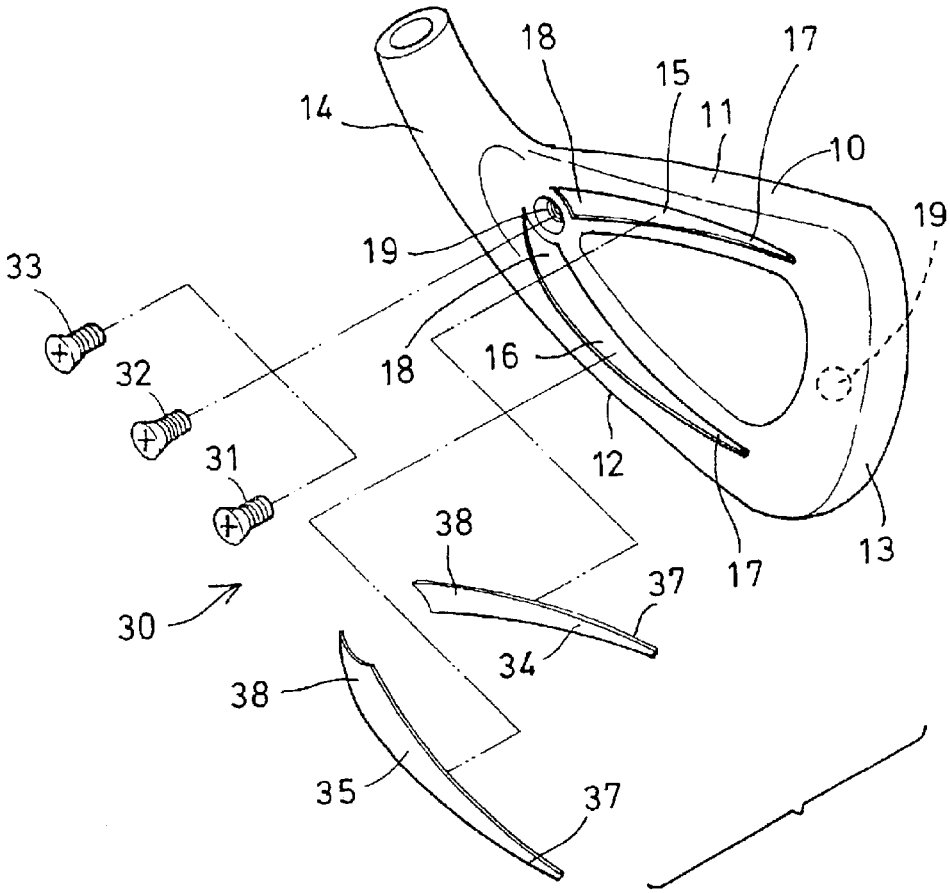
FIG. 1 is an exploded view of a golf club head in accordance with the present invention.
Figure 2:
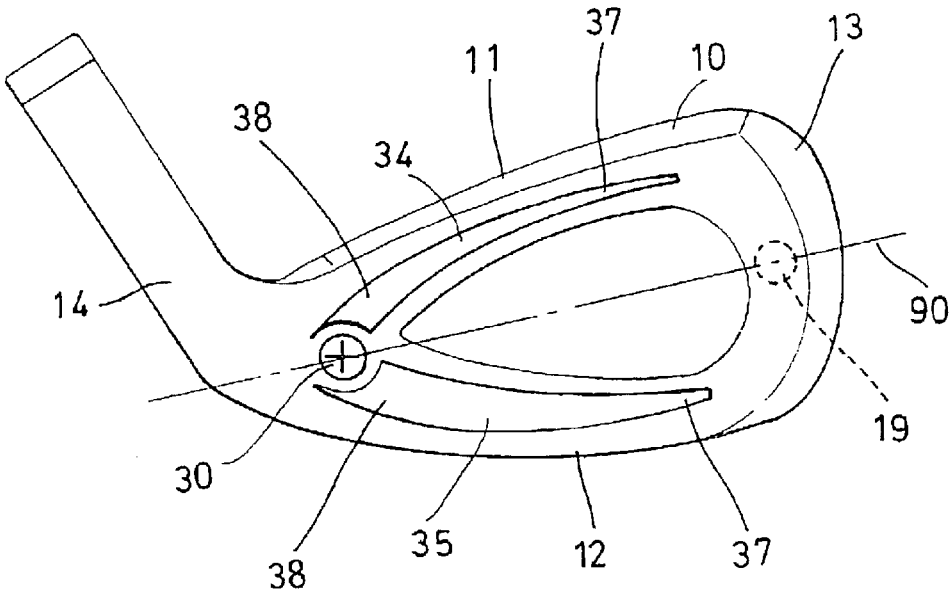
FIG. 2 is a front view of the golf club head.

Referring to the drawings, and initially to FIGS. 1 and 2, a golf club head in accordance with the present invention comprises a head body or head member 10 including an upper portion 11 and a lower portion 12 separated by such as a geometric center line 90. The head member 10 further includes a toe or front portion 13 and a root or rear portion 14.

Each of the upper portion 11 and the lower portion 12 of the head member 10 may further include a recess 15, 16 formed therein, and each having a narrower front portion 17 and a wider or broader rear portion 18. The head member 10 may further include one or more orifices or screw holes 19 formed in either or both the front portion 13 and the rear portion 14 thereof.

A weight device 30 may be provided and attached to the head member 10, in order to adjust the head member 10 to different weight, or to adjust the head member 10 to different center of gravity. For example, the weight device 30 includes one or more fasteners or screws or weight members 31, 32, 33 selectively threaded to the screw holes 19 of the head member 10.

Figure 3:
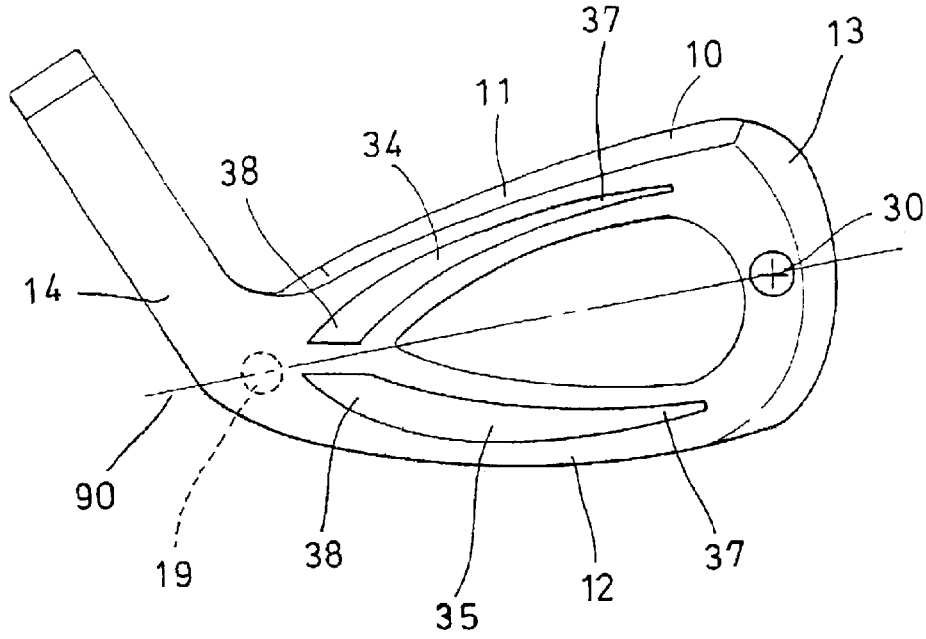
FIG. 3 is a front view of the golf club head, similar to FIG. 2, illustrating the other arrangement of the golf club head.

For example, as shown in FIG. 2, when either of the weight members 31, 32, 33 is secured to the rear portion 14 of the head member 10, the center of gravity of the head member 10 may be adjusted rearwardly. Similarly, the center of gravity of the head member 10 may be adjusted forwardly when either of the weight members 31, 32, 33 is secured to the front portion 13 of the head member 10, as shown in FIG. 3.

For example, when the users who may usually strike the golf balls rightwardly, the users may select and secure either of the weight members 31, 32, 33 to the rear portion 14 of the head member 10. On the contrary, when the users who may usually strike the golf balls leftwardly, the users may select and secure either of the weight members 31, 32, 33 to the front portion 13 of the head member 10, for example.

Similarly, as shown in FIG. 2, when the users who may usually strike the golf balls rightwardly, the users may select and secure one of the weight members 31, 32, 33 having a smaller specific weight, to the rear portion 14 of the head member 10, and may select and secure one of the weight members 31, 32, 33 having a greater specific weight, to the rear portion 14 of the head member 10 when the users who may usually strike the golf balls leftwardly.

Similarly, as shown in FIG. 2, when the users who may usually strike the golf balls rightwardly, the users may select and secure one of the weight members 31, 32, 33 having a smaller specific gravity, to the rear portion 14 of the head member 10, and may select and secure one of the weight members 31, 32, 33 having a greater specific gravity, to the rear portion 14 of the head member 10 when the users who may usually strike the golf balls leftwardly.

Similarly, as shown in FIG. 3, when the users who may usually strike the golf balls rightwardly, the users may select and secure one of the weight members 31, 32, 33 having a greater specific gravity, to the front portion 13 of the head member 10, and may select and secure one of the weight members 31, 32, 33 having a smaller specific gravity, to the front portion 13 of the head member 10 when the users who may usually strike the golf balls leftwardly.

The weight device 30 may further include one or more fasteners or blocks or weight elements 34, 35 selectively engaged into and secured to the head member 10 by such as welding processes, or with adhesive materials, in order to lower the center of gravity of the head member 10 toward the lower portion 12 of the head member 10.

For example, the weight element 34 of smaller specific gravity may be selectively engaged into the recess 15 that is formed in the upper portion 11 of the head member 10, and the other weight element 35 of greater specific gravity may be selectively engaged into the recess 16 that is formed in the lower portion 12 of the head member 10, in order to lower the center of gravity of the head member 10 toward the lower portion 12 of the head member 10.

Similarly, the head member 10 may include only the weight element 35 of greater specific gravity engaged into the recess 16 that is formed in the lower portion 12 of the head member 10, in order to lower the center of gravity of the head member 10 toward the lower portion 12 of the head member 10.

The fasteners or blocks or weight elements 34, 35 may each further include a narrower or smaller front portion 37 and a wider or broader or greater rear portion 38, for engaging into the corresponding narrower front portion 17 and the wider or broader rear portion 18 of the head member 10, in order to further adjust the center of gravity of the head member 10 toward the rear portion 14 of the head member 10.

The head member 10 may be made of various or different iron or metal materials, such as iron materials, stainless steel materials, titanic alloys, etc. For example, when the head member 10 is made of stainless steel materials that include a specific gravity of about 7.9, it is preferable that the weight element 34 is made of lighter materials, such as aluminum alloys (specific gravity of about 2.75), magnesium alloys (specific gravity of about 1.8), titanic alloys (specific gravity of about 4.5), etc., that include a specific gravity smaller than that of the head member 10.

On the contrary, it is preferable that the other weight element 35 is made of heavier materials, such as tungsten and nickel alloys or tungsten and bronze alloys (specific gravity greater than 7.9), in order to further lower the center of gravity of the head member 10 toward the lower portion 12 of the head member 10.

When the head member 10 is made of titanic alloys (specific gravity of about 4.5), it is preferable that the weight element 34 is made of lighter materials, such as aluminum alloys (specific gravity of about 2.75) magnesium alloys (specific gravity of about 1.8), etc., that include a specific gravity smaller than that of the head member 10. The other weight element 35 is preferably made of heavier materials, such as stainless steel materials (specific gravity of about 7.9), tungsten and nickel alloys or tungsten and bronze alloys (specific gravity greater than 7.9), in order to further lower the center of gravity of the head member 10 toward the lower portion 12 of the head member 10.

Accordingly, the golf club head in accordance with the present invention includes a number of weight members or weight elements that may be selectively or adjustably secured to the head member, for allowing the head member to be adjusted to different weight or different center of gravity by the users themselves, and thus for allowing the golf balls to be stricken toward the predetermined or required directions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A golf club head comprising:

a metal head member including an upper portion, a lower portion, a front portion and a rear portion, said head member including a recess formed in said upper portion thereof and having a narrower front portion and a broader rear portion, at least one first weight element attached to said upper portion of said head member, and received in said recess of said head member, and having a specific gravity smaller than that of said head member, said at least one first weight element including a narrower front portion and a broader rear portion to engage into said narrower front portion and said broader rear portion of said recess of said head member, in order to adjust said center of gravity of said head member rearwardly, at least one second weight element attached to said lower portion of said head member, and having a specific gravity greater than that of said head member, to lower a center of gravity of said head member, and at least one weight member attached to said head member, in order to adjust said head member to different center of gravity.

2. The golf club head as claimed in claim 1, wherein said head member includes a screw hole formed in said rear portion thereof, said at least one weight member is threaded to said screw hole of said head member, in order to adjust said center of gravity of said head member rearwardly.

3. The golf club head as claimed in claim 2 further comprising at least one second weight member selectively threaded to said screw hole of said head member, in order to adjust said center of gravity of said head member to different position.

4. The golf club head as claimed in claim 1, wherein said head member includes a screw hole formed in said front portion thereof, said at least one weight member is threaded to said screw hole of said head member, in order to adjust said center of gravity of said head member forwardly.

5. The golf club head as claimed in claim 4 further comprising at least one second weight member selectively threaded to said screw hole of said head member, in order to adjust said center of gravity of said head member to different position.

6. The golf club head as claimed in claim 1, wherein said head member includes a recess formed in said lower portion thereof to receive said at least one second weight element.

7. A golf club head comprising:

a metal head member including an upper portion, a lower portion, a front portion and a rear portion, at least one first weight element attached to said upper portion of said head member, and having a specific gravity smaller than that of said head member, at least one second weight element attached to said lower portion of said head member, and having a specific gravity greater than that of said head member, to lower a center of gravity of said head member, at least one weight member attached to said head member, in order to adjust said head member to different center of gravity, and said head member including a recess formed in said lower portion thereof to receive said at least one second weight element, said recess of said head member including a narrower front portion and a broader rear portion, said at least one second weight element including a narrower front portion and a broader rear portion to engage into said head front portion and said broader rear portion of said recess of said head member, in order to adjust said center of gravity of said head member rearwardly.

* * * * *